US008333648B2

(12) United States Patent
Tarantino

(10) Patent No.: US 8,333,648 B2
(45) Date of Patent: Dec. 18, 2012

(54) GAME USING SECONDARY INDICIA PROVIDING GAME STATUS INFORMATION

(75) Inventor: Elia Rocco Tarantino, Las Vegas, NV (US)

(73) Assignee: AGS, LLC, Henderson, NV (US)

( * ) Notice: Subject to any disclaimer, the term of this patent is extended or adjusted under 35 U.S.C. 154(b) by 2111 days.

(21) Appl. No.: 10/810,782

(22) Filed: Mar. 26, 2004

(65) Prior Publication Data

US 2005/0215309 A1 Sep. 29, 2005

(51) Int. Cl.
*A63F 3/06* (2006.01)

(52) U.S. Cl. ..... 463/18

(58) Field of Classification Search ..... 463/20, 463/19, 18

See application file for complete search history.

(56) References Cited

U.S. PATENT DOCUMENTS

| | | | | |
|---|---|---|---|---|
| 5,401,024 | A * | 3/1995 | Simunek | 463/18 |
| 6,203,428 | B1 * | 3/2001 | Giobbi et al. | 463/16 |
| 6,620,047 | B1 * | 9/2003 | Alcorn et al. | 463/37 |
| 6,783,456 | B2 * | 8/2004 | White | 463/18 |
| 6,887,157 | B2 * | 5/2005 | LeMay et al. | 463/32 |
| 6,955,604 | B1 * | 10/2005 | Graves et al. | 463/42 |
| 2003/0017865 | A1 * | 1/2003 | Beaulieu et al. | 463/16 |
| 2003/0064772 | A1 * | 4/2003 | Tempest et al. | 463/16 |
| 2003/0127793 | A1 * | 7/2003 | Adams | 273/138.2 |
| 2003/0232638 | A1 * | 12/2003 | Luciano, Jr. | 463/12 |
| 2004/0171423 | A1 * | 9/2004 | Silva et al. | 463/31 |
| 2005/0037832 | A1 * | 2/2005 | Cannon | 463/18 |
| 2005/0055115 | A1 * | 3/2005 | Gerrard et al. | 700/91 |

FOREIGN PATENT DOCUMENTS

WO WO 0032286 A1 * 6/2000

OTHER PUBLICATIONS

Casino Research.com! Online Keno Rules, http://www.casino-reseach.com/Rules-Keno.html, Feb. 12, 2004 2 pages.

* cited by examiner

*Primary Examiner* — Dmitry Suhol
*Assistant Examiner* — Jay Liddle
(74) *Attorney, Agent, or Firm* — Weide & Miller, Ltd.

(57) ABSTRACT

In a method of playing a game, secondary indicia are used to provide information regarding game status. In one embodiment, a wagering game such as video keno, video slots or video poker is presented using one or more first indicia such as keno numbers, cards or slot symbols. Secondary indicia are displayed at one or more times to provide game state information such as information regarding win or loss, matching or un-matching symbols, correct or incorrect selections or the like. Preferably, the secondary indicia have one characteristic or attribute indicating one game state (such as a winning selection or outcome) and another characteristic indicating another game statue (such as a losing selection or outcome). One embodiment of the invention is a keno game in which secondary indicia are displayed to provide information regarding whether the player's selected numbers have matched or not.

11 Claims, 5 Drawing Sheets

120

130

GAME USING SECONDARY INDICIA PROVIDING GAME STATUS INFORMATION

FIELD OF THE INVENTION

The present invention relates to methods and apparatus for presenting games for play.

BACKGROUND OF THE INVENTION

Gaming continues to grow in popularity. Legalized wager-based gaming has expanded world-wide. As interest in gaming grows, so does the public's desire for new and exciting games.

Various efforts have been made to make games more interesting. Newer games offer better sound and image effects to excite the player. For example, gaming machines may now play music and present video clips of movies. Newer games are commonly themed, with Playboy®, I Love Lucy®, Monopoly® and other gaming machines offering games which have attributes of these other well-known shows and games.

Other games now offer "bonus" rounds. For example, based upon the outcome of a base game, a player may enter a bonus round where a wheel spins and the player is awarded a bonus win.

The present invention is directed to a game which provided added excitement and pleasure to the gaming experience.

SUMMARY OF THE INVENTION

The present invention comprises a method of playing a game, and apparatus, such as a gaming device and/or system, for presenting the game of the invention. In one embodiment of a method of playing a game, secondary indicia are used to provide information regarding the status of the game.

In one embodiment, a wagering game such as video keno, video slots or video poker is presented using one or more first indicia such as keno numbers, cards or slot symbols. Secondary indicia are displayed at one or more times to provide game state information such as information regarding win or loss, matching or un-matching symbols, correct or incorrect selections or the like. Preferably, the secondary indicia have one characteristic or attribute indicating one game state (such as a winning selection) and another characteristic indicating another game statue (such as a losing selection).

The secondary indicia may be of a variety of types, have various forms, and be displayed at various times during play of the game. In one embodiment, the secondary indicia are "Smiley" indicia (e.g. of the type ☺ ☹). In a preferred embodiment, the characteristics of the secondary indicia which convey game state may comprise the image of the indicia or animation of the indicia conveying mood, such as celebration or happiness, or sadness or loss.

One preferred embodiment of the invention is a game of keno. First indicia comprising keno numbers, such as the numbers 1-80, are displayed. In one embodiment, the numbers are displayed in a keno number grid.

A player selects one or more of the numbers as player selected numbers. A set of game numbers are generated and displayed. In accordance with the game, it is determined if any of the game numbers match any of the player selected numbers.

Preferably, if a player selected number was matched, then a secondary indicia is displayed which provides information regarding the match. If a player selected number was not matched, then a secondary indicia is preferably displayed which provides information that the number was not matched.

In one embodiment, the secondary indicia comprise animated Smiley characters. The characters which are associated with matching numbers are convey celebration and win, while those which are associated with non-matching numbers convey loss. Preferably, the secondary indicia are displayed physically proximate the player selected numbers.

The game of the invention may be implemented in a variety of manners. In one embodiment, the game of the invention is presented at a gaming machine which includes a video display for displaying the first indicia used to play the game and the secondary indicia for conveying game state information.

Further objects, features, and advantages of the present invention over the prior art will become apparent from the detailed description of the drawings which follows, when considered with the attached figures.

DETAILED DESCRIPTION OF THE INVENTION

The invention is a method of playing a game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises a method of playing a game and an apparatus for presenting a game. In one or more embodiments of the invention, a game is played using a first set of indicia. The game may be, for example, a game of video keno, bingo or poker. One or more secondary indicia are used to provide information regarding a state of the game, such as the outcome of the game. In a preferred embodiment, the secondary indicia have a plurality of conditions, with the condition of the second indicia providing game state information.

Figure 1:
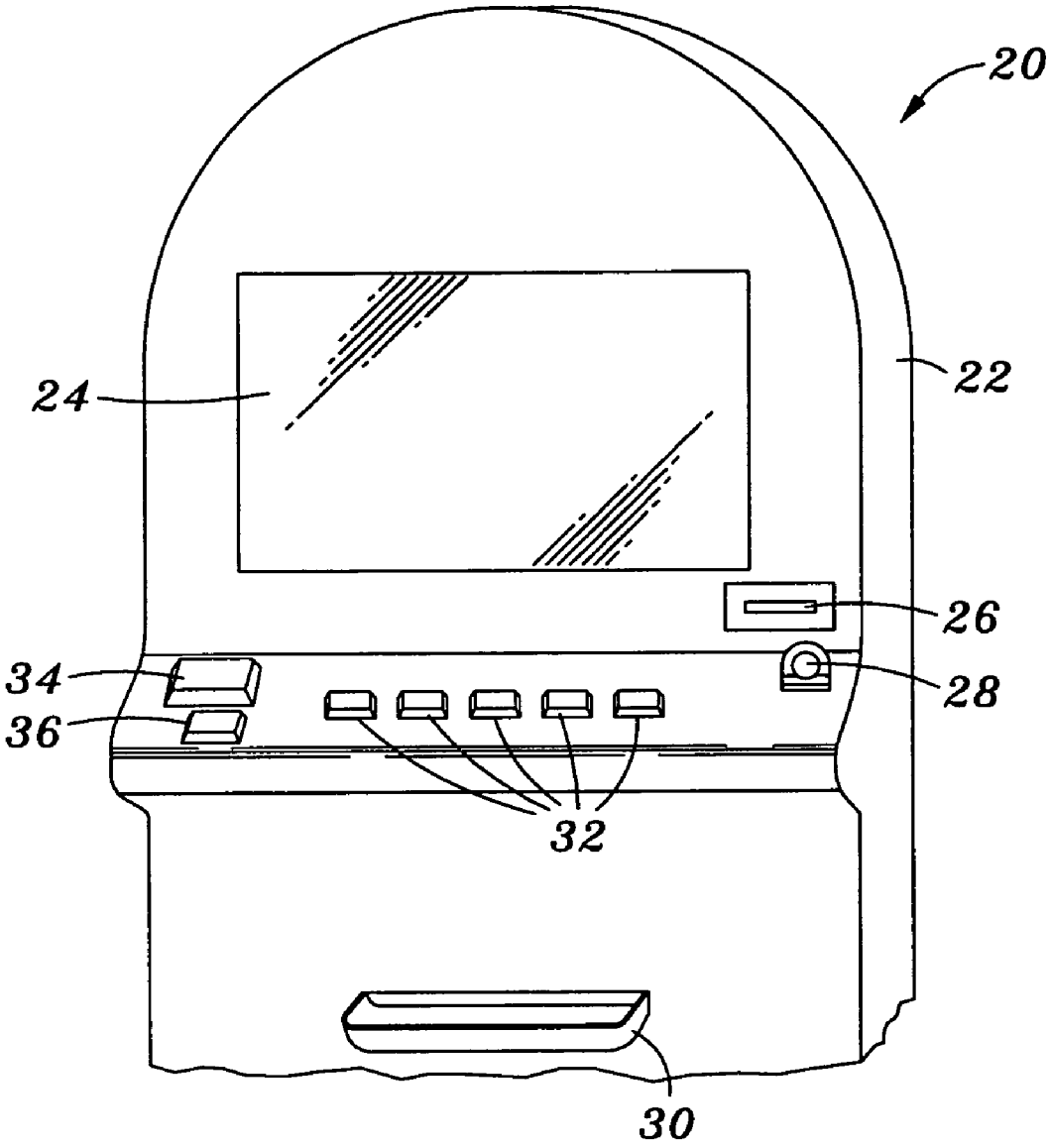
FIG. 1 illustrates a gaming device of the type which may be used to implement a game in accordance with the invention for play by a player.

In a preferred embodiment, the game is presented to a player with a gaming machine. FIG. 1 illustrates a gaming machine 20 in accordance with one embodiment of the invention. As illustrated, the gaming machine 20 includes a housing 22 for enclosing/supporting various components of the gaming machine. The gaming machine 20 includes a display 24 for displaying information, such as game indicia. In one embodiment, the display 24 is a video type display, such as a CRT, LCD, plasma or other display. Speakers (not shown) or other devices may be provided for generating sound associated with the game.

In one embodiment, the game may be played as a wager-type game which requires that a player place a bet or wager to play the game. Preferably, if the player is a winner of the game, then the player is provided an award, such as a monetary payout (such as coins) or other prizes. As illustrated, the gaming machine 20 may include a bill validator/acceptor 26 for accepting paper currency and a coin acceptor 28 for accepting coins. Other means of payment, such as a credit card reader, may be provided. An award of winnings in the form of coins may be paid to the player via a coin tray 30.

Preferably, the gaming machine 20 includes means for a player to provide input. In one embodiment, this means comprises one or more buttons. For example, a plurality of card "hold" or "select" buttons 32 may be provided for permitting a player to hold/select cards in a hand. A deal/draw button 34 permits a player to indicate that he/she wishes the game to start or to draw replacement cards. A bet button 36 is provided for a player to select the amount to bet on a particular game. In one embodiment, a display of the gaming machine 20 may permit touch or similar direct input thereto.

A game controller (not shown) is provided for controlling the various devices of the gaming machine and for providing game information. For example, the game controller may be arranged to generate video and audio data for presentation by the display and speakers of the gaming machine 20. The game controller may be arranged to detect a signal from the coin acceptor indicating the receipt of coins, and may be arranged to cause a coin delivery mechanism to deliver coins from a coin hopper to the coin tray 30.

It will be appreciated that the gaming machine 20 may have a variety of configurations, and that the gaming machine 20 illustrated and described above is but an example of a device for implementing the game of the present invention. In one or more embodiments, the gaming machine 20 may be associated with a network and receive game information remotely and may transmit information, such as payout and game play information, to a remote location.

A specific version of a game of the invention will be described with reference to FIGS. 2-5 to aid in understanding the invention. Additional aspects of the invention will be described below, it being understood that the invention is not limited to the configuration illustrated in FIGS. 2-5 and now described.

In accordance with the invention, a game is presented to a player for play. In the embodiment illustrated in FIG. 2, the game is the game of keno. In this embodiment, the game is presented via the display of a gaming machine, such as the gaming machine illustrated in FIG. 1.

As illustrated, the game is played using a first set of indicia 120. In this embodiment, the indicia 120 comprise the numbers 1-80. In this embodiment, the numbers are illustrated in grid-format as is known in the art of the keno game.

As illustrated, various additional information may be displayed to the player, such as information identifying the game being played and a paytable 122. The paytable 122 preferably provides information regarding winning amounts paid or awarded for particular winning combinations based upon the player's wager. Of course other or additional information may be displayed such as the rules or instructions of the game.

In the game of keno, a player selects one or more numbers from the set of numbers, in an attempt to match the selected numbers against a set of game numbers. As also illustrated in FIG. 1, the player may make selections of the numbers via an input, such as by touch-input to the display which is displaying the numbers. The particular number of numbers which are selected may vary depending upon the rules of the game and/or player desire. For example, the player may often be permitted to select as few as 1 and as many as 20 numbers in normal keno games. In this embodiment, the player has selected 7 numbers, numbers 1, 4, 13, 27, 43, 56 and 80.

In the game of keno, a set of game indicia are selected. The game indicia comprise a set of randomly selected numbers from the set of keno numbers (e.g. selected from the numbers 1-80). The number of game indicia which are selected may vary. In one embodiment, 20 numbers are selected.

Figure 2:
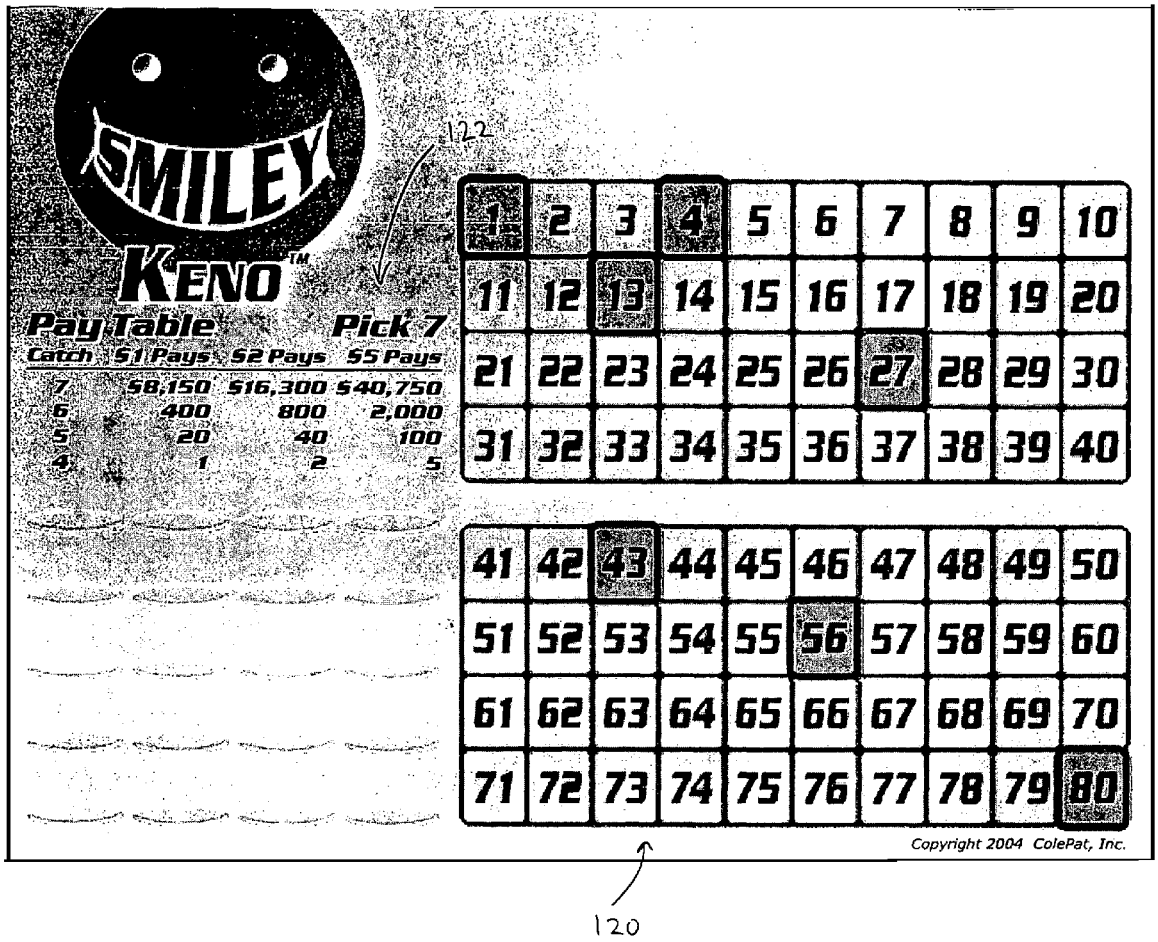
FIG. 2 illustrates the display of numbers utilized to play a game of keno in accordance with an embodiment of the invention with player selected numbers displayed.
Figure 3:
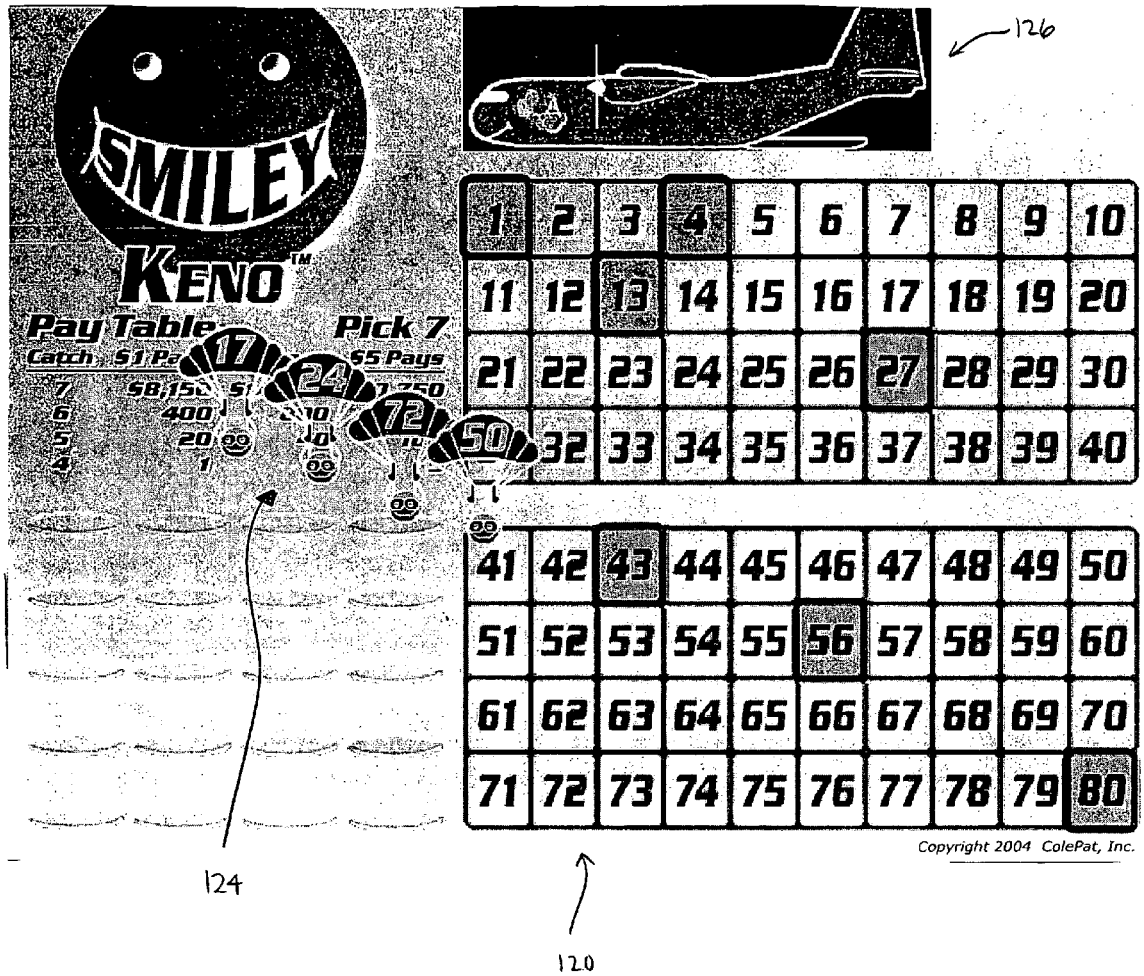
FIG. 3 illustrates the generation and display of game numbers for play of the game.

FIGS. 2 and 3 illustrate one embodiment of a method of displaying and/or selecting the numbers. As illustrated, an animated event is utilized to display the selected numbers. In one embodiment, the animated event comprises "parachuters" 124 exiting an overflying airplane 126.

Figure 4:
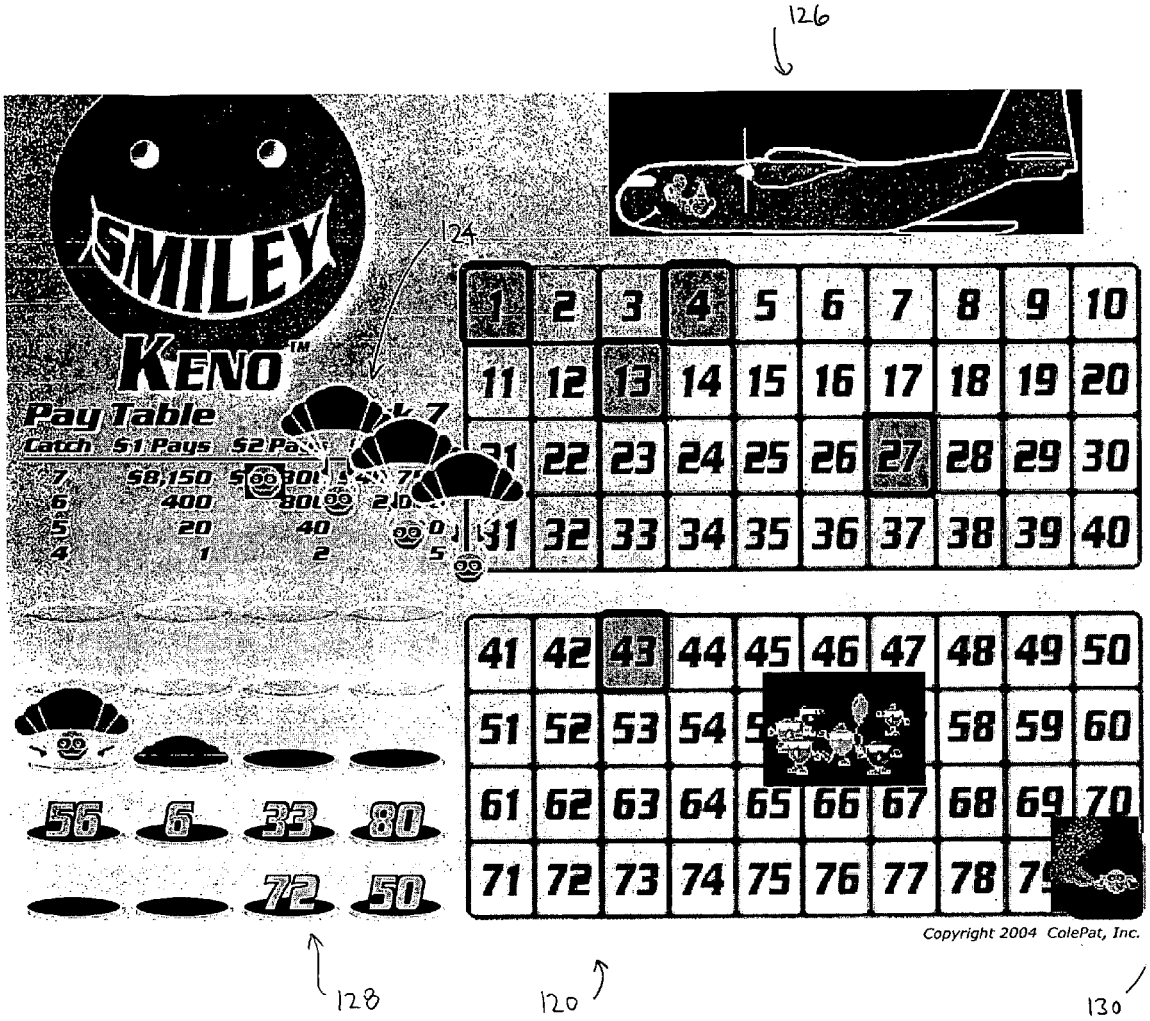
FIG. 4 further illustrates the display of game numbers which are compared to the player selected numbers as well as the display of secondary indicia in accordance with the invention.

As illustrated in FIG. 4, these parachuters 124 float downwardly from the top towards the bottom of the display. As they do so, they open their parachutes, each revealing one of the game numbers 128 for that game. In one embodiment, the game numbers 128 are "deposited" in game number spaces adjacent the displayed game board.

It will be appreciated that the game numbers may be generated and displayed in a variety of fashions. The game numbers may be generated using a random number generator, such as located at the gaming machine. The game numbers may simply be displayed in positions or, as illustrated, displayed as part of an animated sequence which adds interest and excitement to the game.

As is known in the game of keno, the outcome of the game is determined by comparing the player selected numbers to the game numbers. If a minimum number of matches has resulted, then the player may be declared a winner. A payout or other award may be provided to the player for such a result.

In accordance with the invention, game state information is provided by secondary indicia 130. The secondary indicia may be referred to as secondary elements, displays or by other terminology. In the embodiment illustrated in FIGS. 4 and 5, the secondary indicia 130 comprise "Smiley" characters. These characters may have a wide variety of forms, such as ☺ and ☹.

In this embodiment, when a player selected number matches a game number 128, then a secondary indicia 130 preferably identifies that match. As illustrated in FIG. 4, the game numbers "56" and "80" have been displayed. These numbers match the same numbers selected by the player. As a result, secondary indicia 130 in the form of Smiley characters are displayed. Preferably, the secondary indicia 130 are displayed at or adjacent the player's matching number (i.e. in physical proximity as viewed by the player). This provides an indication to the player that a match has occurred.

In a preferred embodiment, the nature, state, condition, appearance or the like of the secondary indicia is used to indicate different game state information. As illustrated in FIG. 4, in the event of a match, the Smiley characters show a happy, winning or celebratory condition.

Figure 5:
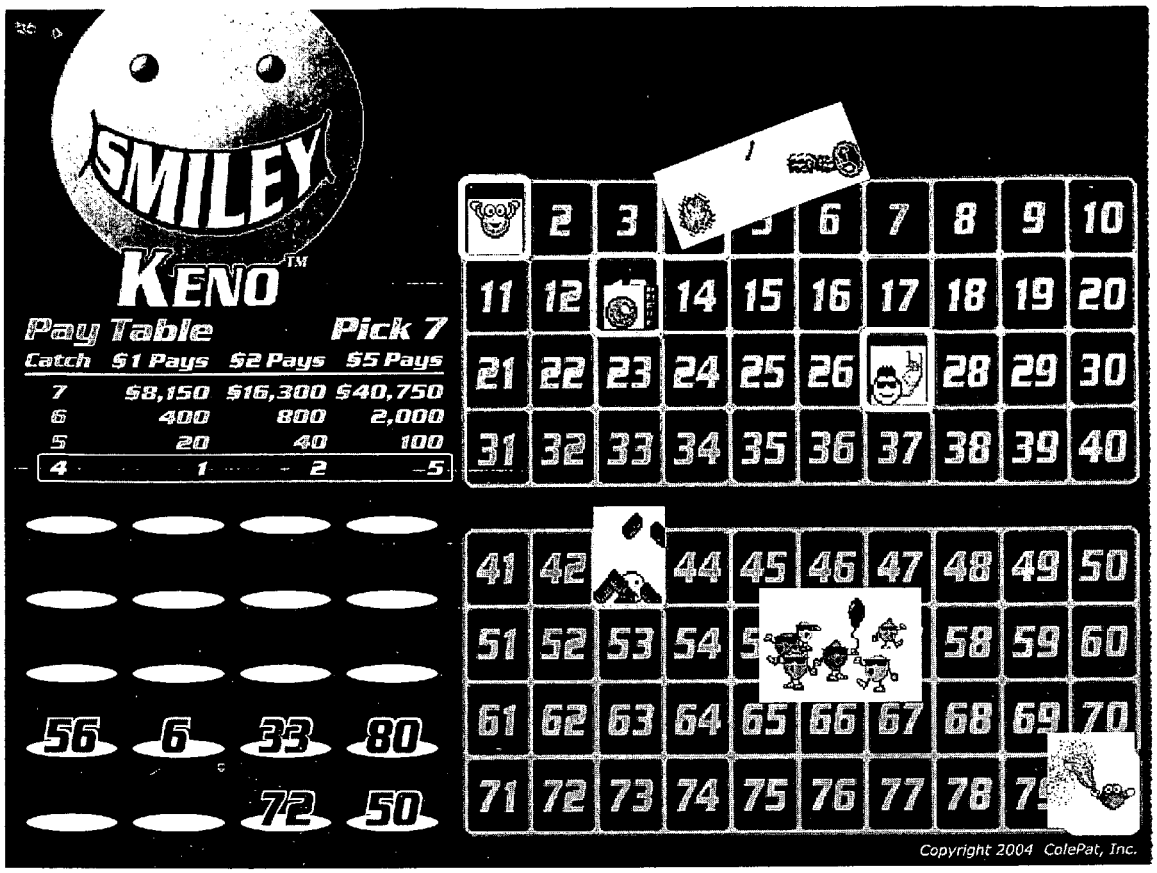
FIG. 5 illustrates the result of a game of keno in accordance with the invention in which secondary indicia are displayed, the secondary indicia providing game state information pertaining to whether the player selected numbers matched the game name numbers.

Referring to FIG. 5, after all the game numbers 128 have been selected and displayed, it is known whether certain of the player selected numbers were not matched. In the game illustrated, the player selected numbers "13" and "43," for example, were not selected. Preferably, secondary indicia 130 are used to identify or convey such to the player. These secondary indicia 130 preferably convey a different game state than those used to identify matches. In the embodiment illustrated, the secondary indicia 130 comprise Smiley characters which are sad, mad, frustrated or the like.

This embodiment game has a "Smiley" theme, in that the secondary indicia used to convey game state information apart from the first indicia used to play the game, are "Smiley" characters. As indicated, these characters may have a variety of forms and, most preferably, are capable of conveying "meaning" as to the condition or state of the game, such as a winning or positive outcome, and a losing or negative outcome.

The method of the invention will now be described in additional detail. In accordance with the method, a game is presented to a player. In one embodiment, the game is a wagering type game. In this embodiment, the player places a wager, such as win coins, currency, credits or other means now known or later developed. Preferably, in such a game format, the player is awarded winnings, such as monies, credits, prizes or the like, depending upon the outcome of the game.

The particular game which is presented, including the various steps of the play of the game, may vary. In a preferred embodiment, the game is presented on a video-type gaming machine, thus allowing for the simple generation and display of the secondary indicia. For example, the game may be the game of keno, bingo, poker, slots or the like, as presented on video-type gaming machine. Of course, the game may be any of the wide variety of games now known or later developed.

The game is preferably presented to the player at a gaming machine such as described above. Of course, the game could be presented using a variety of devices and systems. For example, the game could be presented to a player at a terminal of a gaming system including a remote server or servers which generate game information for presentation at the terminal.

Depending upon the particular game, various player inputs may be received. These inputs may include a wager, selection of indicia, such as cards to be held, keno numbers which are selected at the like. As indicated, these inputs may be accepted in a variety of fashions, such as with buttons, through a touch-screen or the like.

Of course, the player may be permitted to select the game they wish to play. For example, the gaming machine may present a menu of games for selection by the player.

Preferably, the game is played using one or more first indicia. The first indicia may also be referred to as game indicia or other terminology. The first indicia may depend upon the particular game which is presented. For example, in the game of keno, the first indicia may comprise the numbers 1-80. In the game of poker, the first indicia comprise cards, such as the 52 cards corresponding to a standard deck of playing cards. The first indicia might, in that case, also include Jokers or the like. It is appreciated that there may be a variety of first indicia, such as numbers on cards and numbered balls in the game of bingo, or a great variety of indicia in the game of slots. In all cases, however, one or more indicia are used to present and play the game.

In accordance with the invention, secondary indicia are used to indicate game state or condition. The various forms of the secondary indicia, and when and how they are displayed or presented may vary. Most preferably, the secondary indicia are different from the first indicia, and do not comprise any of the first indicia or variations thereof. In this manner, the secondary indicia are readily identifiable by the player as being separate from the indicia which are actually being used to play the game itself.

As will be appreciated, various games may have different states or conditions. These states may correspond to stages of the game, winning and losing selections, winning and losing outcomes, and other events. For example, in the case of the game of keno, as described, the state of the game may include whether particular player selected numbers matched or did not match the selected game numbers. In the game of video poker, the state of the game may include whether particular cards comprise a predetermined winning combination of cards. In the case of bingo, the state of the game may include whether or not certain matching indicia comprise a winning pattern.

The secondary indicia need not be displayed in conjunction with every game state. For example, in the case of video poker, secondary game indicia may not be displayed during the initial display of dealt cards and the selection of held cards. The secondary indicia may be displayed, however, in association with the cards of the resulting or final hand.

Of course, the secondary indicia could be displayed at more than one time (i.e. at more than one game stage/state). For example, in the game of video poker, secondary indicia could be displayed in association with selected or held cards, and then again in association with the resulting hand. In the game of bingo, secondary indicia could be displayed when a match is received, as well as in the event a bingo or "matching pattern" has resulted.

The secondary indicia which are displayed may vary. As described, in a preferred embodiment, the secondary indicia are configured to convey information to the player regarding the game state, such as a positive or negative outcome or result or the like. As a result, the appearance of the indicia, its size, shape, motion or other attribute is preferably selected to provide such information. The particular attribute of the secondary indicia is preferably selected to be detected by the player through observation. In one embodiment, the secondary indicia may be animated, with the mannerisms, portrayed "mood" or other actions conveying the desired information.

As described, in one embodiment, the secondary indicia comprise Smiley characters. These characters have the advantage that they are readily recognized and, because they have a "face," imparted facial expression is useful in conveying information to the player. Of course, the secondary indicia could comprise a wide variety of other elements or characters. For example, the secondary indicia could comprise images of animals, such as dogs or cats. The indicia could comprise animated human forms or inanimate objects. The secondary indicia also need not comprise indicia all of the same type or theme.

In one embodiment, the secondary indicia may include textual information and may include animation of events. For example, the secondary indicia could include textual information regarding win, loss or the like. The secondary indicia could comprise animated events such as winning or losing celebration information.

The secondary indicia may be displayed or presented in a variety of manners. In a preferred embodiment, secondary indicia are associated with the first or primary indicia. For example, in the game of keno described above, secondary indicia are associated with player selected first indicia to provide information regarding whether the player's selections were matching. In the case of video poker, the secondary indicia could be associated with individual displayed cards. In the case of bingo, the secondary indicia could be associated with selected numbers/balls, or with game indicia displayed on a player's game card or the like.

At the conclusion of game play, a winning or losing result may be declared. A player may be paid winnings, credits, prizes or the like in the event the outcome of the game is a winning outcome.

In one embodiment, the secondary indicia may change over time or change depending as the game state changes. For example, in the game of keno, secondary indicia may be displayed in conjunction with each player selected number as each number is selected. In one embodiment, at this time the indicia may comprise an image of a Smiley face showing a happy face or mood. As the game numbers are selected and matches are determined, the state of the secondary indicia may change to reflect the new game state. For example, if a player selected number is matched, the secondary indicia associated with that number may be animated in a celebratory format or action. Other the other hand, the secondary indicia associated with non-matching numbers may be change to images of unhappy or sad characters or animated to show loss, sadness or the like.

The invention has numerous advantages. First and foremost, the invention has the advantage of adding excitement to the play of game. For example, in the game of keno, normally a simple grid of numbers is displayed, a player makes selections, and the game numbers are displayed. Matches are determined. As presented on a video display, this method of game play lacks any visual excitement. The use of secondary indicia in accordance with the invention adds a great deal of visual stimulation to the play of the game.

More importantly, the secondary indicia provide information to the player. The secondary indicia provide game state information apart from the first indicia which are actually used to present the game. Further, the secondary indicia have, as described above, various forms or conditions for indicating different game states. For example, in the case of the game of video keno, the secondary indicia may be associated with the first or primary indicia to provide information to the player as to whether the player selected numbers were matched or not. This avoids, for example, the player having to compare each of their selections on the grid to the selected game numbers. Instead, the player can simply and easily view just the grid and determine by the secondary indicia whether the selected number was matched or was not matched.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a game of keno at a gaming device comprising the steps of:

displaying a set of keno numbers;

accepting input from a player regarding one or more player selected numbers from said keno numbers;

designating said player selected numbers with a first indicator;

selecting a set of game numbers;

determining if one or more of said game numbers match one or more of said player selected numbers;

as to each player number which is matched by a game number, removing said first indicator and displaying a match indicating secondary indicia in association with said matched player number, said match indicating secondary indicia not including said first indicator and said match indicating secondary indicia having an attribute indicating to said player that said player number was matched; and as to each player number which is not matched by a game number, removing said first indicator and displaying a non-match indicating secondary indicia in association with said unmatched player number, said non-match indicating secondary indicia not including said first indicator, said non-match indicating secondary indicia differing from said match indicating secondary indicia, and said non-match indicating secondary indicia having an attribute indicating to said player that said player was not matched; and determining the outcome of said game.

2. The method in accordance with claim 1 wherein said set of match indicating and non-match indicating secondary indicia are Smiley characters.

3. The method in accordance with claim 1 wherein said attribute indicating a match is animation of said secondary indicia to indicate happiness or celebration.

4. The method in accordance with claim 1 wherein said attribute indicating no match is animation of said secondary indicia to indicate unhappiness or loss.

5. The method in accordance with claim 1 wherein one or more of the match indicating secondary indicia differ from one another in appearance.

6. The method in accordance with claim 1 wherein a matching indicating or non-match indicating secondary indicia is displayed in physical proximity to each player selected number.

7. The method in accordance with claim 1 wherein said secondary indicia are other than numbers.

8. The method in accordance with claim 1 wherein said game is played as a wagering type game and including the step of accepting a wager from a player to play said game.

9. The method in accordance with claim 1 wherein said steps of displaying are performed on a video display of said gaming device.

10. The method in accordance with claim 1 wherein said first indicator comprises highlighting of said keno numbers which comprise player selected numbers.

11. The method in accordance with claim 1 further including the step of indicating said selected game numbers by a second indicator.

* * * * *